United States Patent [19]

Anthony et al.

[11] 4,164,257

[45] Aug. 14, 1979

[54] INTERNAL PROTECTION OF WELL CASING

[75] Inventors: Donald R. Anthony, Dallas; Lee Bone, III, Plano; William G. Price, Midland, all of Tex.

[73] Assignee: Atlantic Richfield Company, Los Angeles, Calif.

[21] Appl. No.: 860,939

[22] Filed: Dec. 15, 1977

[51] Int. Cl.[2] ..... E21B 43/00

[52] U.S. Cl. ..... 166/113; 166/65 R

[58] Field of Search ..... 166/65 R, 113, 242, 166/243, 244 C, 248, 305 R, 133; 175/320, 325; 204/196; 21/2.7 R, 54 R

[56] References Cited

U.S. PATENT DOCUMENTS

| | | | |
|---|---|---|---|
| 1,804,078 | 5/1931 | Baden | 166/65 R |
| 2,810,440 | 10/1957 | Kenneday et al. | 166/242 X |
| 3,497,443 | 2/1970 | Von Burgsdorff | 204/196 |
| 3,497,444 | 2/1970 | Paiton | 204/196 |
| 3,768,563 | 10/1973 | Blount | 166/305 R |
| 3,769,521 | 10/1973 | Caldwell et al. | 175/5 X |
| 3,818,996 | 6/1974 | McCaleb | 175/320 |

*Primary Examiner*—James A. Leppink
*Assistant Examiner*—Richard E. Favreau
*Attorney, Agent, or Firm*—M. David Folzenlogen

[57] ABSTRACT

In a water injection well, in place of corrosion inhibitors, the internal surface of a lower section of the casing is protected from corrosion by one or more galvanic sacrificial anodes placed in the section of casing. The anodes are mounted on a metal member which is connected to or suspended from the tubing or a well packer. The metal member extends below a certain point in the well into the section of casing. The metal member may be a tail pipe or it may be a wireline retrievable member specially prepared for this purpose. Anodes made of an aluminum alloy are especially suited to this corrosion protection system.

14 Claims, 1 Drawing Figure

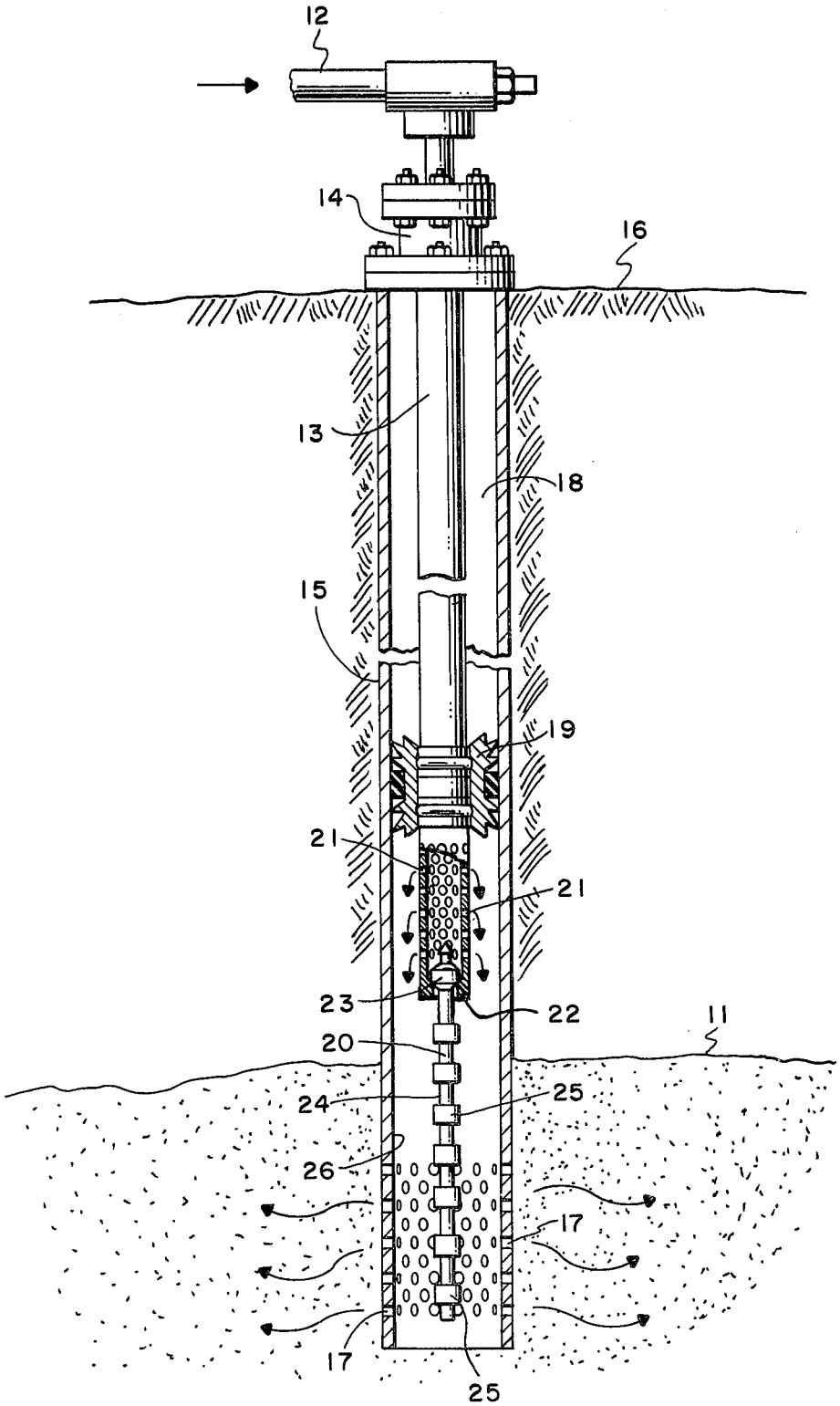
12
14
16
13
18
15
19
21
21
23
22
11
20
24
25
26
17
17
25

INTERNAL PROTECTION OF WELL CASING

BACKGROUND OF THE INVENTION

This invention relates to the prevention of internal corrosion in a water injection well with galvanic sacrificial anodes. Preferably, the anodes will be capable of being installed and removed by a wireline.

In the production of crude oil and other minerals, water is frequently injected through a well into a subsurface formation. The wells may be converted producing wells or they may be specifically drilled for water injection. The typical water injection well has a casing set alone or extending past a subsurface formation into which the water is to be injected. In the latter case, the casing is perforated over an appropriate interval of the subsurface formation. The water is injected through tubing extending from the surface to a well packer set above the open end or perforated area of the casing. This leaves a section of casing below the packer. It is common practice to internally coat the tubing with a protective coating and to protect the external or outer surface of the tubing by sealing off the casing-tubing annulus with a packer with a treated fluid above the packer. On the other hand, the internal surface of the section of casing below the packer rarely has a protective coating. This internal surface of the casing corrodes unless the water is carefully treated and controlled or a corrosion inhibitor is injected with the water. The water flow rate may vary or even be shut off for certain periods. Corrosion inhibition and surface treatment of the injection water are the established ways of preventing internal casing corrosion of the section. Even if these standard practices were otherwise effective, metal anomalies may be present in the casing and cause corrosion.

It is common practice to use sacrificial anodes for prevention of corrosion of certain surface equipment like heaters and to use cathodic protection for protection of exterior surfaces. The weight and size of the anodes is based on the nature of the fluids or soils and the surface areas to be protected. Generally, there is adequate space for adequate size and weight anodes and for enough distance to allow the protective current to spread out. In addition, it is relatively easy to change the anodes when needed. In a water injection well, the space is very limited because the tubing must be adequately sized to carry sufficient rates of water injection and because the diameter of the casing is quite limited. The use of sacrificial anodes for protection of the internal surface of a lower section of casing in a water injection appears not to have been previously suggested.

SUMMARY OF THE INVENTION

In a typical water injection well, with or without a casing-tubing packer, corrosion of the internal surface of a lower section of casing is reduced by installing one or more galvanic sacrificial anodes in the section. The anodes are mounted on a metal member extending below the standard tubing. In a preferred embodiment, the anode is made up of an aluminum alloy. In a still more preferred embodiment, the tubing and the metal member are adapted to allow the anodes and metal member to be run into and removed from the well by a wireline. The anodes and metal member are suspended from the tubing and left in the well until it is time to check or change anodes.

BRIEF DESCRIPTION OF THE DRAWING

The drawing is a fragmented, partially sectionalized side view of a water injection well with a sacrificial anode system.

DETAILED DESCRIPTION OF THE PREFERRED EMBODIMENTS

As used herein, the words "galvanic sacrificial anode" refer to any sort of piece or section of a metal or a metal alloy which is higher in the electromotive series than iron and which is connected to or mounted on a metal member so that cathodic protection current may be applied to the internal surface of a section of well casing made predominately of iron. The words "metal member" refer to the elongated piece or section of metal onto which the anode or anodes are mounted. The metal member may be a section of tubing, a perforated section of tubing, a tail pipe, a perforated tail pipe, a metal rod, and the like.

The drawing illustrates a preferred embodiment of a system wherein a lower internal section of water injection well casing is protected from corrosion by a galvanic sacrificial anode on a metal member extending into the section of casing. The well may be a converted producing well or a well specifically drilled for water injection. Water is injected into subsurface formation 11 through flowline 12 into tubing 13 which is suspended from well hanger 14. The tubing is usually made of steel and is internally coated with a protective coating. The upper end of the tubing is clamped in tubing hanger and the tubing is thereby electrically connected to the casing head and tubing hanger through a metal conductive path.

Tubing 13 is hung inside well casing 15. The casing extends downward from surface 16 of the earth to at least a suitable point above or in subsurface formation 11. As shown, the casing extends through the subsurface formation and is perforated with perforations 17 through which the injected water passes.

The tubing outside diameter, for example, 6 centimeters (2.375 inches), is smaller than the casing inside diameter, for example, 10 centimeters (4 inches) and 12 centimeters (4.7 inches). This creates casing-tubing annulus 18. At a suitable point which may be at or above the lower end of tubing 13 is well packer 19 which divides the casing into an upper and a lower section. The well packer seals the annular space between the casing and tubing above the packer from the lower casing section or the annular space below the packer.

Tubing 13 may extend through the packer or it may end at the packer and a tail pipe used to extend the tubing to below the packer. In any event, for purposes of this invention, the tubing ends where metal member 20 starts, whether or not the metal member is a lower section of tubing.

As shown, tubing 13 extends to a suitable point below the packer and above perforations 17. The distance between the lower end of the tubing and perforations 17 will vary depending on the techniques used in completing the well. By way of example, this distance may be 61 meters (200 feet). As shown, the lower portion of tubing 13 below packer 19 is perforated with tubing perforations 21 so that the inside of the tubing is in flow communication with the lower section of casing by way of perforations 21 and the injection water may flow out of these perforations. In this way, the bottom end of the tubing may be used for a preferred embodiment of this invention.

At the bottom end of the tubing is seating means 22, for example, a typical seating nipple, adapted to receive upper end 23 of metal member 20. The upper end of the metal member is adapted to rest on the seating means and allow the metal element to be suspended from the seating means and extend downwardly into the section of casing 15 below the bottom end of the tubing. The upper end is also adapted to allow the metal member to be run into and out of the tubing on a wireline in a standard fashion. For the sake of simplicity, the upper end is depicted as having a spearhead which may be latched into a wireline retriever.

The metal member extends downwardly from the lower end of tubing 13 to the perforations in casing 15. Metal member 20 has outer surface 24. Surrounding the outer surface of the metal member are a series of galvanic sacrificial anodes 25. In other words, the anodes are between outer surface 24 of the metal member and inner surface 26 of a lower section of casing 15.

The anodes are comprised of a metal or metal alloy higher than iron in the electromotive series, for example, aluminum, magnesium, zinc and the like. The space and clearance is too small for a relatively large amount of sacrificial metal. It is, therefore, desirable that the anode be comprised of material that provides adequate protective voltage and current with a low degree of metal loss due to impurities or anomalies in the anode itself. The rate of consumption of the anode is sufficiently slow to enable the anode to last an efficient length of time. The preferred sacrificial metal is an aluminum alloy of the type being used for other purposes as anodes in water systems.

The anodes are electrically connected to the metal member through a metallic conductive path. In the same manner, upper end 23 of the metal member is electrically connected to tubing 13 which, as previously noted, is electrically connected to casing hanger 14. Casing 15 is also electrically connected through a metallic conductive path to hanger 14. Galvanic anodes 24 are able to impress a cathodic protection current onto the inside surface of the lower section of casing 15.

The metal member could be one or more sections of perforated or nonperforated tubing or tail pipe on which the anodes are mounted, for example, molded split cylindrical anodes with an inside diameter equal to the outside diameter of the tail pipe and with an outside diameter less than the inside diameter of casing 15. The two halves of the anodes could be bolted together on the tail pipe. For example, the anodes could be 30.5 centimeters (1 foot) long mounted 61 centimeters (2 feet) on centers. If the metal member is a section of tubing or tail pipe, it would be necessary to pull the tubing to change the anodes.

In the preferred embodiment of this invention, the anodes and metal element are capable of being lowered on a wireline through the tubing and be suspended from and extend below the tubing. For example, the metal element could be one or more sections of half inch sucker rod and the anodes 152 centimeters (60 inches) long with a 2.54 centimeter (1 inch) outside diameter mounted on the half inch sucker rod. Preferably, the anode-bearing metal member will extend from near the casing-tubing annulus to adjacent the perforations in casing 15.

In operation, the metal member with at least one galvanic sacrificial anode mounted thereon is lowered into casing 15 to extend through the area of the casing that requires corrosion protection. Preferably, as described, the metal member will be suitable for being lowered on a wireline through tubing 13. The metal element and anode or anodes will be left in place. As water is injected into tubing 13, the water will flow down the tubing, out peforations 21, down past anodes 25 and out casing perforations 17 into subsurface formation 11. The voltage difference, or electromotive force, of the anodes will cause ionic current to flow through the water between anodes 25 and internal surface 26 of the casing. Metallic conducted current will flow through the metal member, up tubing 13, through packer 19 or through tubing hanger 14 to casing 15 back down to internal surface 26. After a sufficient length of time, the anodes will be replaced either by pulling the tubing and metal member or by lowering a wireline with a fishing head to latch onto the upper end of the metal member and pull it up and out of tubing 13.

The principle preferred galvanic sacrificial anode system for internally protecting a lower section of casing and its mode of operation have been illustrated and described. It is to be understood that, within the scope of the approved claims, the invention may be practiced otherwise than as specifically illustrated and described. For example, the tubing could be nonmetallic and, as mentioned, the metal conductive path between the metal member and the casing could be through the packer sealing the casing-tubing annulus.

The embodiments of the invention in which an exclusive property or privilege is claimed are defined as follows:

1. A water injection well system for protecting the internal surface of a downhole section of casing from internal corrosion comprising:

a. a well casing extending downward from the surface to a first point in a subsurface formation;

b. injection well tubing extending downward from the surface inside said casing to a second point, said second point being at a higher elevation than said first point, said tubing having a lower end at said second point;

c. a metal member extending downward from said lower end of said tubing to said first point, said metal member being electrically connected to said casing through a metallic conductive path, said metal member having an outer surface spaced laterally from said internal surface of the section of said casing between said first and said second point; and d. at least one galvanic sacrificial anode attached to said outer surface of said metal member between said metal member and said internal surface of said section of said casing, said at least one anode being electrically connected to said metal member through a metallic conductive path.

2. The protective system of claim 1 wherein the galvanic sacrificial anode is comprised of an aluminum alloy.

3. The protective system of claim 1 wherein the lower end of the tubing is a seating means and the metal member has an upper end adapted to suspend from said seating means and adapted to be run into and out of said tubing on a wire line.

4. The protective system of claim 3 wherein the galvanic sacrificial anode is comprised of an aluminum alloy.

5. The protective system of claim 1 wherein the tubing has an outer surface spaced laterally from the internal surface of the casing thereby forming a casing-tubing annulus, the annular space above a third point being sealed at said third point by a packer from the annular space below said packer, said third point being at a higher elevation than the second point, the inside of said tubing being in flow communication with the annular space below said third point.

6. The protective system of claim 5 wherein the galvanic sacrificial anode is comprised of an aluminum alloy.

7. In a method of protecting the internal surface of a lower section of well casing from corrosion by water injected through well tubing into said lower section of said casing and wherein an annular space between said tubing and said casing is sealed from said lower section, the improvement comprising lowering at least one galvanic sacrificial anode through said tubing into said section of said casing and leaving said at least one anode in said section during the injection of water into said tubing.

8. The improved method of claim 7 wherein the galvanic sacrificial anode is comprised of an aluminum alloy.

9. A water injection well system for protecting the internal surface of a downhole section of casing from internal corrosion comprising:

a. a well casing extending downward from the surface to a first point in a subsurface formation;

b. injection well tubing extending downward from the surface inside said casing to a second point, said second point being at a higher elevation than said first point, said tubing having a lower end at said second point;

c. a metal member extending downward from said lower end of said tubing to said first point, said metal member being electrically connected to said casing through a metallic conductive path, said metal member having an outer surface spaced laterally from said internal surface of the section of said casing between said first and said second point; and d. at least two galvanic sacrificial anodes attached to said outer surface of said metal member between said metal member and said internal surface of said section of said casing, said at least two anodes being spaced longitudinally from each other and being electrically connected to said metal member through a metallic conductive path.

10. The protective system of claim 9 wherein the galvanic sacrificial anodes are comprised of an aluminum alloy.

11. The protective system of claim 9 wherein the lower end of the tubing is a seating means and the metal member has an upper end adapted to suspend from said seating means and adapted to be run into and out of said tubing on a wire line.

12. The protective system of claim 11 wherein the galvanic sacrificial anodes are comprised of an aluminum alloy.

13. The protective system of claim 9 wherein the tubing has an outer surface spaced laterally from the internal surface of the casing thereby forming a casing-tubing annulus, the annular space above a third point being sealed at said third point by a packer from the annular space below said packer, said third point being at a higher elevation than the second point, the inside of said tubing being in flow communication with the annular space below said third point.

14. The protective system of claim 13 wherein the galvanic sacrificial anodes are comprised of an aluminum alloy.

* * * * *